United States Patent [19]

Zohler

[11] Patent Number: 5,054,548

[45] Date of Patent: Oct. 8, 1991

[54] HIGH PERFORMANCE HEAT TRANSFER SURFACE FOR HIGH PRESSURE REFRIGERANTS

[75] Inventor: Steven R. Zohler, Manlius, N.Y.

[73] Assignee: Carrier Corporation, Syracuse, N.Y.

[21] Appl. No.: 602,539

[22] Filed: Oct. 24, 1990

[51] Int. Cl.[5] ..... F28F 1/36

[52] U.S. Cl. ..... 165/133; 165/184; 29/890.05; 29/890.048

[58] Field of Search ..... 165/133, 184, 181; 29/890.05, 890.48, 890.46

[56] References Cited

U.S. PATENT DOCUMENTS

| | | | |
|---|---|---|---|
| 3,496,752 | 2/1970 | Kun et al. | 165/133 |
| 3,696,861 | 10/1972 | Webb | 29/890.05 |
| 3,768,290 | 10/1973 | Zatell | 29/890.05 |
| 3,881,342 | 5/1975 | Thorne | 29/890.05 |
| 4,765,058 | 8/1988 | Zohler | 29/890.048 |

*Primary Examiner*—Albert W. Davis, Jr.

[57] ABSTRACT

A heat transfer surface for effecting boiling of a high pressure refrigerant in contact with the surface. The surface includes a plurality of spaced apart fins which extend from the side in contact with the boiling fluid. Each of the fins has a base portion joined to the base of the surface and a tip portion. The tip portions are bent over towards the next adjacent one of the fins to define a subsurface channel between adjacent fins. The subsurface channel has alternating closed sections where a length of the tip portion is bent over by an additional amount so that the length of the tip portion contacts an adjacent fin, and, open sections wherein the bent over tip portion is spaced from the adjacent fin. Each of the open sections has a cross sectional area of from 0.000220 square inches to 0.000440 square inches such that the open sections define alternating re-entrant openings of a size to promote optimum boiling of a high pressure refrigerant. The total open area of the open sections is from 14% to 28% of the total surface area.

9 Claims, 3 Drawing Sheets

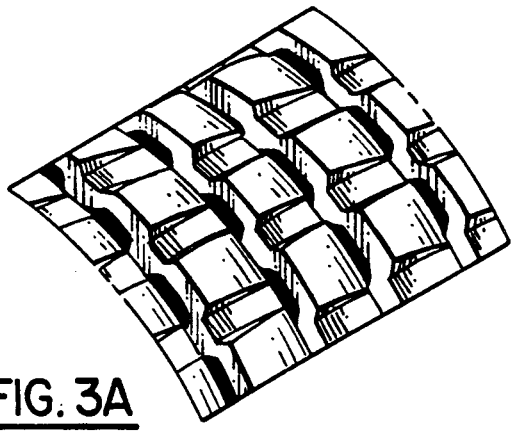
FIG. 3A
PRIOR ART
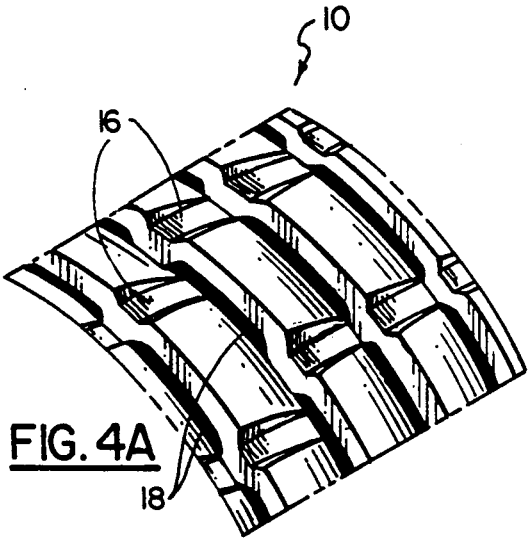
FIG. 4A
FIG. 3
PRIOR ART
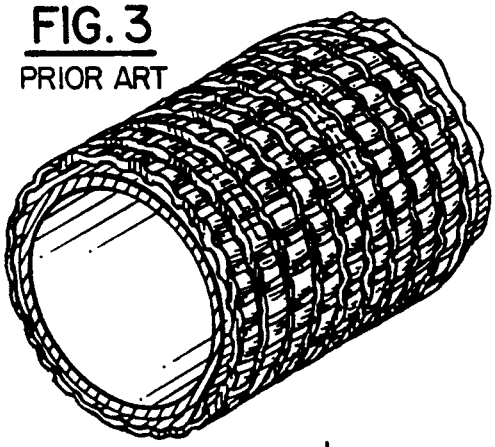
FIG. 4
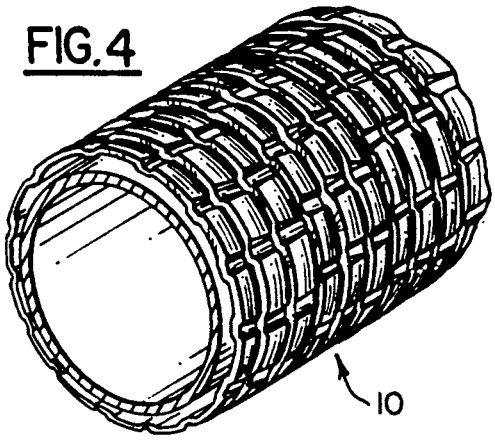
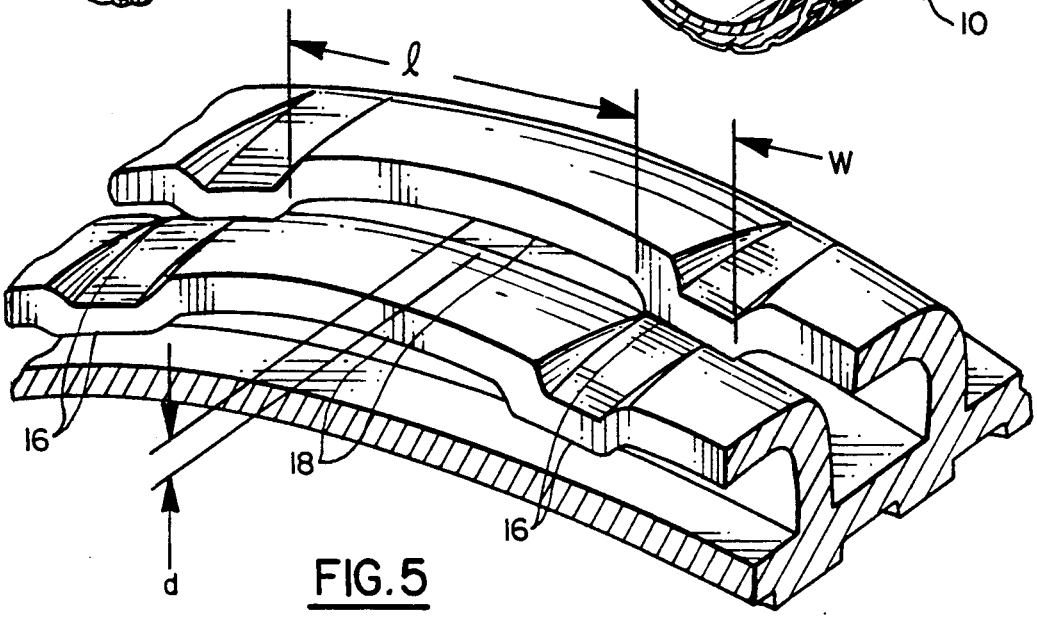
FIG. 5

HIGH PERFORMANCE HEAT TRANSFER SURFACE FOR HIGH PRESSURE REFRIGERANTS

BACKGROUND OF THE INVENTION

1. Field of the Invention

This invention relates to a heat exchanger apparatus for use with a boiling liquid. More particularly this invention relates to a heat exchanger tube having a fluid to be cooled passing therethrough and a boiling refrigerant in contact with the external surface of the tube.

2. Description of the Prior Art

In certain refrigeration applications such as a chiller or an evaporator, liquid to be cooled is passed through a tube while liquid refrigerant is in contact with the outside of the tube. The refrigerant changes state from a liquid to a vapor, thus absorbing heat from the fluid to be cooled within the tube. The selection of the external configuration of the tube is extremely influential in determining the boiling characteristics and overall heat transfer rate of the tube.

It has been found that the transfer of heat to a boiling liquid is enhanced by the creation of nucleate boiling sites. It has been theorized that the provision of vapor entrapment cavities in the heat exchanger surface creates sites for nucleate boiling.

In nucleate boiling, liquid adjacent to a trapped vapor bubble is superheated by the heat exchanger surface. Heat is transferred to the bubble as this liquid vaporizes at the liquid-vapor interface and the bubble grows in size until surface tension forces are overcome by the buoyancy and momentum forces and the vapor bubble breaks free from the surface. As the bubble leaves the surface, fresh liquid wets the now vacated area and the remaining vapor has a source of additional liquid for creating vapor to form the next bubble The vaporization of liquid and continual stripping of the heated liquid adjacent to the heat transfer surface, together with the convection effect due to the agitation of the liquid pool by the bubbles result in an improved heat transfer rate for the heat exchanger surface. The mechanism for the heat transfer taking place within the vapor entrapment cavities is most accurately described as thin film evaporation.

It is known that the surface heat transfer rate is high in the area where the vapor bubble is formed. Consequently, the overall heat transfer rate tends to increase with the density of vapor entrapment sites per unit area of heat exchanger surface. See for example, U.S. Pat. No. 3,696,861 issued to Webb and entitled "Heat Transfer Surface Having A High Boiling Heat Transfer Coefficient". In the Webb Patent, fins on a heat exchange tube are uni-directionally rolled over toward an adjacent fin to form a narrow gap between adjacent fins. In Webb it is theorized that these narrow gaps create sub surface vapor entrapment sites or cavities and that the narrow gaps act as reentrant openings intercommunicating the entrapment sites or cavities with the boiling liquid.

It is also well known in the theory of boiling heat transfer that tubes having a continuous gap between adjacent fins may suffer from reduced performance in that an excessive influx of liquid refrigerant from the surroundings may be drawn into and flood or deactivate a vapor entrapment site.

The flooding problem has been addressed, and enhanced tubes having sub-surface channels communicating with the surroundings through surface openings or pores which alternate with closed sections have been devised. Such a tubing is shown for example in U.S. Pat. No. 4,438,807 to Mathur et al entitled "High Performance Heat Transfer Tube". The Mathur Patent provides for alternating openings and closed sections wherein the openings for the cavities occur only at those locations above an internal rib or depression formed within the tube.

U.S. Pat. No. 4,765,058, entitled "Apparatus For Manufacturing Enhanced Heat Transfer Surface" issued to the assignee hereof on Aug. 23, 1988 in the name of Zohler. This Patent discloses a finned tube having a plurality of sub-surface channels defined by bent over adjacent fins which communicate with the outside space through a large number of evenly spaced, generally fixed size surface pores.

The '058 Patent points out that the size of the sub-surface channels and the size, number, and configuration of the pores on the surface of the tubes are particularly critical for R-11 applications. It has been found that tubing manufactured according to the teachings of the '058 Patent provide an extremely high performance evaporator tube for use with low pressure refrigerants such as R-11. It has been discovered however that a pore density according to the teachings of the '058 Patent did not produce the expected high performance heat transfer characteristics in higher pressure refrigerants, such as for example, R-22.

R-11 is a member of the family of refrigerants known as Chlorofluorocarbons (CFC's). Recently, there has been a growing scientific consensus that emissions of CFC's are contributing to the depletion of a layer of stratospheric ozone that protects the earth's surface from the harmful effects of ultra violet radiation. International agreements, and, federal and state regulations are being considered that will regulate use, manufacture, importation, and disposal of CFC's in the future R-22 is a member of a chemical family known as hydrochlorofluorocarbons HCFC's). It is believed that because of their hydrogen component, HCFC's break down substantially in the lower atmosphere and, as a result, their ozone depletion potential is substantially lower than that of R-11 and other CFC refrigerants. Accordingly it is expected that R-22 will be used more extensively in the future.

SUMMARY OF THE INVENTION

It is an object of the present invention to provide an externally enhanced heat transfer surface for use with a high pressure refrigerant.

Another object of the invention is to provide a high performance heat transfer tube which will sustain boiling at a relatively high rate in a high pressure refrigerant.

A further object of the present invention is to provide a high performance nucleate heat transfer tube having alternating evenly spaced generally fixed size surface pores for use with a high pressure refrigerant.

It is another object of the present invention to provide a high performance boiling tube for providing optimum heat transfer when used with high pressure refrigerants such as R-22.

These and other objects of the present invention are obtained by a heat exchanger which includes a heat conductive base member for transferring heat from a heat source on one side thereof to a boiling fluid on the other side. A plurality of spaced apart fins extend from the side in contact with the boiling fluid.

Each of the fins has a base portion joined to the base member and a tip portion. The tip portions are bent over towards the next adjacent one of the fins to define a subsurface channel between adjacent fins. The subsurface channel has alternating closed sections where a length of the tip portion is bent over by an additional amount so that the length of the tip portion contacts an adjacent fin, and, open sections wherein the bent over tip portion is spaced from the adjacent fin. Each of the open sections has a cross sectional area of from 0.000220 square inches to 0.000440 square inches such that the open sections define alternating re-entrant openings of a size to promote optimum boiling of a high pressure refrigerant. The total open area of the open sections is from 14% to 28% of the total surface area of the other side.

BRIEF DESCRIPTION OF THE DRAWING

The novel features that are considered characteristic of the invention are set forth with particularity in the appended claims. The invention itself, however, both as to its organization and its method of operation, together with additional objects and advantages thereof, will best be understood from the following description of the preferred embodiment when read in connection with the accompanying drawings wherein like numbers have been employed in the different figures to denote the same parts and wherein:

FIG. 3 is a perspective view of a prior art heat transfer tube according to U.S. Pat. No. 4,765,058;

FIG. 3*a* is an enlarged view of a portion of the surface of the tubing of FIG. 3;

FIG. 4 is a perspective view of a high performance evaporator tube for use with high pressure refrigerants according to the present invention;

FIG. 4*a* is an enlarged view of a portion of the heat transfer surface of the tube of FIG. 4;

FIG. 5 is an enlarged, approximately 50 times, fragmentary view of the heat transfer surface of the tube of FIG. 4.

DESCRIPTION OF THE PREFERRED EMBODIMENT

The heat exchange surface and tubing of the present invention represents a specific improvement over that as illustrated in prior Zohler U.S. Pat. No. 4,765,058 assigned to the assignee hereof. This tubing, as in the prior Zohler Patent may be produced by first forming an external fin convolution on the outer surface of an unformed tube with the use of fin forming disks. Subsequently the tip portions of adjacent fin convolutions are bent over toward adjacent fins. This produces a substantially confined elongated space which extends around the outside of the tubing and which will be referred to hereinafter as a sub-surface channel. If the fins are separate circular fins, each space comprises a single annular sub-surface channel. If on the other hand, the fins are helical, then the sub-surface channels extend helically around the exterior of the tubing.

As disclosed in the prior Zohler Patent, the sub-surface channels have alternating closed sections where a length of the tip portion is bent over an additional amount to contact an adjacent fin, and, open sections where the bent over tip portion is spaced from the adjacent fin. The open sections define alternating re-entrant openings which promote boiling of a fluid in which the tubing is submerged.

It has been discovered that tubing made according to the Zohler '058 Patent, having a large number of very small, evenly spaced, fixed sized surface pores provided substantially improved heat transfer performance when used with low pressure refrigerants such as R-11. The use of this same tubing however, with higher pressure refrigerants, such as for example R-22, did not yield the performance improvements expected.

According to the present invention it has been found that the cross-sectional area of the individual pores themselves are critical to obtaining substantially improved heat transfer capabilities when used with higher pressure refrigerants such as R-22.

Figure 1:
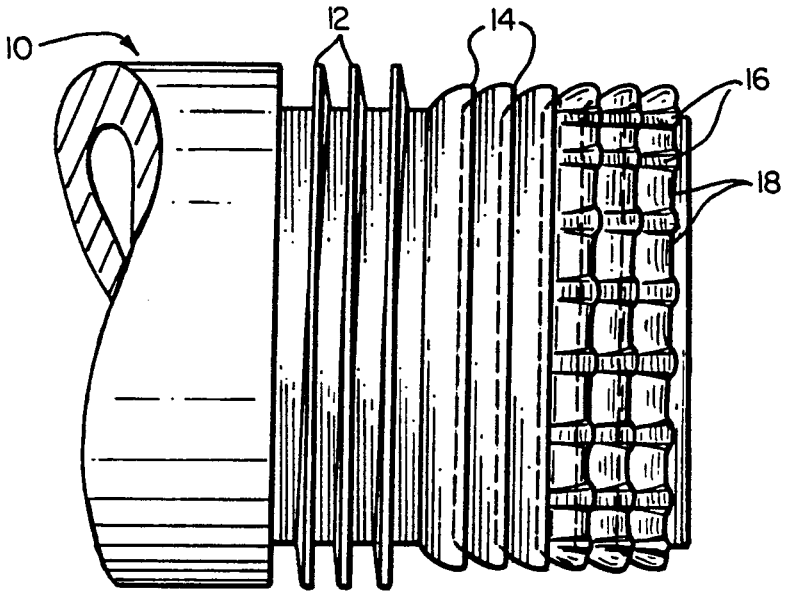
FIG. 1 is a front elevation view of a finned tube showing a number of the fins shaped to provide the nucleate boiling surface of the invention.

Referring now to the drawings, FIG. 1 illustrates the manner in which the heat transfer surface of the present invention is applied to a previously unformed tube. This Figure shows the progressive stages of the forming of the heat transfer surface which may be made in accordance with the teachings of the Zohler '058 Patent. A plurality of spaced apart fins 12 extend from the base member or tube 10, and may be connected in a continuous helical pattern as in the configuration shown. The fins 12 could be made from a separate material and attached to the outer surface of tube 10 or they could be machined from tube 10 so as to be integral therewith. Moving to the right in FIG. 1 the fins 12 have been bent over so that the tip portions 14 of each fin 12 are spaced from but not in contact with the next adjoining fin. The last three rows of fins in FIG. 1 show the fins following appropriate working to create the alternating closed and open sections identified by reference numerals 16 and 18 respectively.

Before continuing with the description of the preferred embodiment it should be pointed out that all of the drawing figures herein depict the tubing, surfaces and openings therein in a manner which is not to actual scale. Many of the features of the invention are "microscopic". As used herein the term "microscopic" refers to objects so small or fine as to be not clearly distinguished without the use of a microscope. In a typical tubing according to the present invention the tube surface will appear to the naked eye as having a helical spiral therearound with a roughened surface. The individual closed and open sections however cannot be readily distinguished without the aid of a microscope. Since the actual cross-sectional area of the open sections are critical to the present invention, the surfaces, and openings have been shown in a manner such that the size of these openings relative to the prior art may be appreciated. The actual dimensions of the "microscopic" features further, are critical to the invention as claimed and, accordingly, the sizes of these features are given in detail herein with reference to the drawing figures.

For comparison, FIG. 3 shows a heat transfer tube according to the '058 Patent. FIG. 3A shows an enlargement of the surface of the tube of FIG. 3.

FIG. 4 shows a heat transfer tube, according to the present invention, for use with higher pressure refrigerants FIG. 4A shows an enlargement of the surface of the tube of FIG. 4. In the tube of FIGS. 4 and 4A, every other closed section 16 (compared to FIGS. 3 and 3A) has been eliminated, resulting in half as many openings 18 around the circumference, for the same size tube. The size of the individual openings is substantially larger than those of prior art tubing, as will be seen.

Turning to FIG. 5 the dimensions of a heat transfer tube according to the ,058 patent providing a high performance heat transfer surface for use in R-11 will be described. Following that the corresponding dimensions for a high performance heat transfer tube for use with higher pressure refrigerants will be given. The dimensions to be referred to will first be defined and/or described and will then be given in tabular form.

Outside diameter: OD is the nominal diameter of the tubing with the heat transfer surface formed thereof.

External fins per inch: this figure represents the number of fins as identified by reference numeral 12 in FIG. 1 formed per linear inch of tubing.

Notch width: with reference now to FIG. 5 the "notches" are defined as the closed portions of the heat transfer surface and the notch width is represented by the circumferentially measured dimension "W".

Number of notches/fin/revolution. This represents the number of notches as described above per revolution of the tube and this number necessarily also equals the number of open regions or "pores" per fin per revolution around the tube.

Pore dimensions: The dimensions "l" and "d" are identified in FIG. 5 as representing nominal linear dimensions of an individual pore opening.

Pore Size: The shape of each individual pore is dimensionally similar to a half of an ellipse. Making use of well known geometric relationships for an ellipse, the cross sectional area of an individual pore is best approximated by the following equation:

$$\textit{Pore Area} = \tfrac{1}{2}\pi(\text{“}\tfrac{1}{2}\text{”})\,(d)$$

R-11 tube according to U.S. Pat. No. 4,765,058
Nominal diameter: 0.720 inches
External fins/inch: 42.5
Notch width: W=0.011 inches
Number of notches/fin/revolution: 67
Pore dimensions: d=0.0045 inches. l=0.0298 inches From the above, a nominal cross-sectional area of a pore for an R-11 tube may be calculated as $\frac{1}{2}\pi(\text{“}\frac{1}{2}\text{”})(d)=0.000105$ *square inches.*

High Performance Tube For Higher Pressure Refrigerants
Nominal diameter: 0.720 inches
External fins/inch: 42.5
Notch width: W=0.011 inches
Number of notches/fin revolution: 34
Pore dimensions: d=0.0063 inches. l=0.062497 inches Using the above, the nominal cross-sectional area of a pore for a high pressure refrigerant high performance tube is 0.000309 square inches.

It will be noted with reference to the above that the cross-sectional area of an individual pore opening for a high pressure, high performance tube is in the order of three times the cross-sectional area of that which provides good performance when used with a low pressure, R-11, refrigerant.

In order to more completely define the differences between the high pressure refrigerant tube of the present invention and the prior art, a comparison will be made of the total area of the pores of the tubes described in the above examples. For a solid tube having a nominal diameter (d) of 0.720 inches a cylindrical reference area, per linear inch of tube, may be calculated as $A=\pi d=2.262$ square inches. Using this as a reference the percentage of open area for each tube may be calculated as follows:

$$\text{Percent Open Area} = \frac{\text{Open Area/per inch}}{2.262\ \text{in}^2/\text{inch}}$$

$$\text{Percent Open Area R-11 Tube} = \frac{(67\ \text{openings/Fin})(.000105\ \text{in}^2)(42.5\ \text{Fins/inch})}{2.262\ \text{in}^2/\text{inch}} = 13.2\%$$

$$\text{Percent Open Area R-22 Tube} = \frac{(34\ \text{openings/fin})(.000309\ \text{in}^2)(42.5\ \text{fins/inch})}{2.262\ \text{in 2/inch}} = 19.7\%$$

A comparison of the percent open area for the R-11 tube according to U.S. Pat. No. 4,765,058 to that for R-22 tube, according to the present invention, showns that the total open area is approximately 50% greater for the R-22 tube.

Refrigerants falling within the group of higher pressure refrigerants for which the present invention is believed to impart substantially increased performance include, but is not limited to, R-12, R-13, R-22, R-134a, R-152a, R-500, R-502 and R-503.

A convenient relationship to assist in defining the term "higher pressure refrigerant" in connection with the present invention is the well known Clausius-Clapeyron equation:

$$\frac{dp}{dT} = \frac{\lambda}{T\Delta V}$$

where:
P=Pressure
T=Temperature at which a phase change occurs
λ=latent heat of phase change
ΔV=volume change accompanying the phase change.

This equation is the fundamental equation relating latent heat of a phase change to the other defined parameters. The term dp/dT may be simply defined as the slope of the vapor pressure curve, and, may be readily calculated for different refrigerants using data from published refrigerant tables and charts. Such data is available, for example, in a number of publications of ASHRAE, the American Society of Heating, Refrigerating and Air Conditioning Engineers.

The value of the term dp/dT, at 40° F., for several refrigerants considered to be low pressure refrigerants are listed below in Table 1. Likewise dp/dT for a number of higher pressure refrigerants are presented in Table 2.

TABLE 1

| dp/dT For Low Pressure Refrigerants | |
|---|---|
| Refrigerant | $\frac{dp}{dT}$ |
| R-11 | .163 psi/°F. |
| R-113 | .071 psi/°F. |
| R-114 | .33 psi/°F. |
| R-12 | .88 psi/°F. |
| R-13 | 4.52 psi/°F. |
| R-22 | 1.47 psi/°F. |
| R-134a | .979 psi/°F. |
| R-152a | .89 psi/°F. |
| R-500 | 1.10 psi/°F. |
| R-502 | 1.62 psi/°F. |
| R-503 | 6.27 psi/°F. |

From the above tables it is evident that the slope of the vapor pressure curve is substantially greater for higher pressure refrigerants. For the purpose of the present invention, the term higher pressure refrigerant is meant to include refrigerants having a slope of the vapor pressure curve dp/dt which is greater than about 0.60 psi/°F.

It is believed that the substantially increased performance with higher pressure refrigerants is achieved in tubes according to the present invention where the cross sectional area of the individual pores is within the range of 0.000220 square inches to 0.000440 square inches, and, where the total area of the open sections is from 14% to 28% of the total surface area of the active heat transfer surface.

Further, for use with R-22 it has been found that the cross sectional area of the individual pores should be within the range of from 0.000267 square inches to 0.000353 square inches, and, the total area of the open sections is from 16.7% to 22.5% of the total surface area of the active heat transfer surface.

Figure 6:
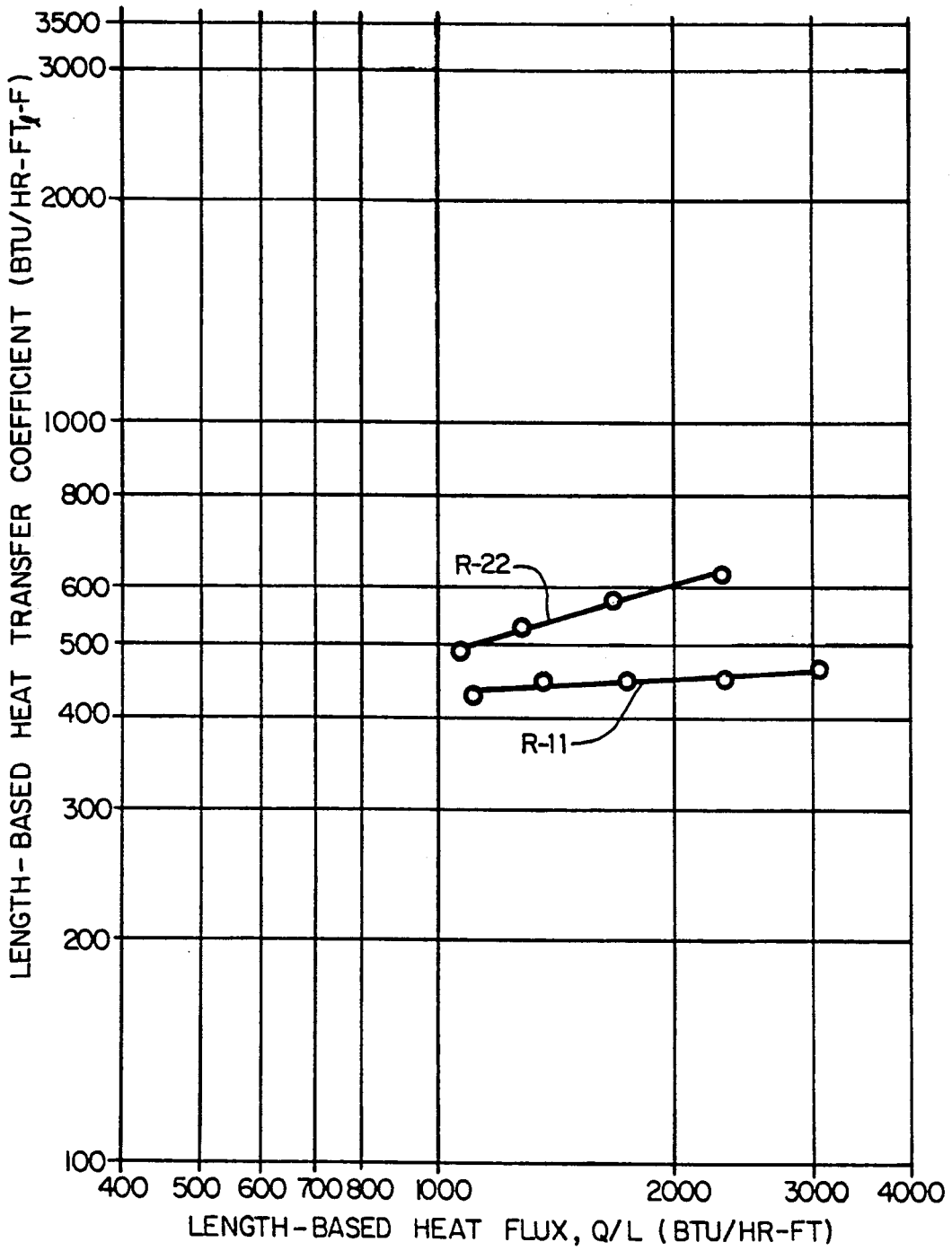
FIG. 6 is a graphical representation of the boiling performance, in a high pressure refrigerant, of the high performance evaporator tube of the present invention in comparison with a prior art enhanced tube.

Referring now to FIG. 6, there is graphically shown a comparison of length based heat transfer coefficient and length based heat flux between tube "R-22" embodying the tube according to the present invention, and tube "R-11" embodying a tube according to U.S. Pat. No. 4,765,058. For the purpose of this comparison both tubes were tested in R-22 and as can be seen by the comparison, the high performance evaporator tube "R-22", in accordance with the present invention, exhibits a performance improvement ranging from approximately 20 to 40 percent over the length-based heat transfer coefficient of the "R-11" tube, when used in R-22 refrigerant.

Figure 2:
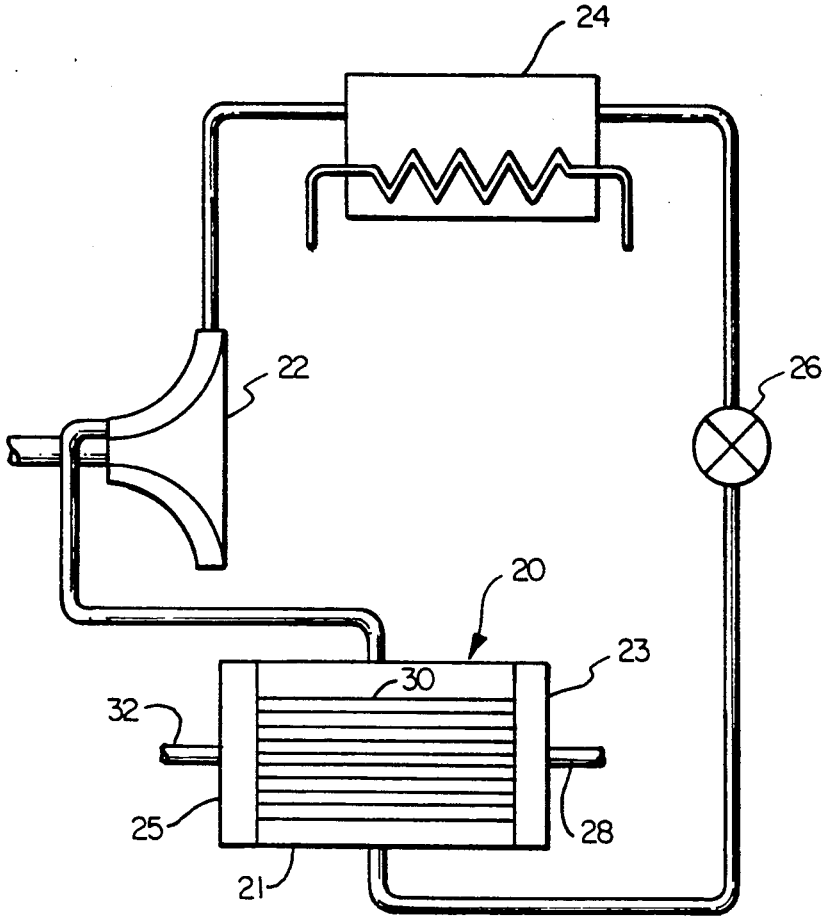
FIG. 2 is a diagrammatic view of a refrigeration system including an evaporator in which the nucleate boiling surface of the invention could be used.

FIG. 2 illustrates diagrammatically a standard compression refrigeration system with a shell-and-tube evaporator 20 in which the heat transfer surface of the invention could be used. Evaporator 20 is connected in a refrigeration circuit including a compressor 22, a condenser 24, and an expansion device 26. Either a reciprocating or centrifugal type of compressor could be employed, with a centrifugal compressor 22 having been shown for illustrative purposes. Evaporator 20 is comprised of a shell 21, headers 23 and 25, and closely spaced tubes 30 for conducting fluid to be cooled from the inlet header 23 to the outlet header 25. Water, or other fluid to be cooled, flows from inlet 28 through tubing 30 and is discharged through outlet 32. Refrigerant liquid from condenser 24 is expanded into shell 21 as it flows from expansion valve 26. The refrigerant which enters evaporator 20 is a mixture of liquid and vapor. The liquid is evaporated as the refrigerant flows through shell 21 in contact with the outside of tubing 30. Heat transfer to the refrigerant thus takes place by the combined modes of forced convection and nucleate boiling.

While the exact mechanism which operates to allow the present invention to provide a high performance boiling surface for increased heat transfer when used with a high pressure refrigerant is difficult to define with certainty, it is believed that the large difference in vapor density between low pressure refrigerants and high pressure refrigerants may help to explain the reason that the larger cross-sectional area openings result in increased performance for higher pressure refrigerants. The liquid density of high and low pressure refrigerants, such as for example R-22 and R-11, are very similar. On the other hand, there is a very large difference between vapor density of these refrigerants, with low pressure refrigerant having an extremely high vapor volume per pound of refrigerant. As a result, for the same volume liquid, a low pressure refrigerant will yield a much larger volume of vapor, or bubble as the vapor manifests itself in a boiling situation.

Summarizing briefly what is believed to happen in a boiling heat transfer situation with sub-surface channels and re-entrant openings. It is believed that the liquid refrigerant is induced, by a favorable pressure difference, through some re-entrant openings into the sub-surface channels. As the liquid refrigerant begins to heat up it is vaporized at the "thin film" vapor-liquid interface in the sub-surface channel. Vapor forms and attempts to exit from the sub-surface channel through other re-entrant openings. As the bubble exits it forms a region of low pressure in the cavity, which, in turn sucks in liquid to replenish that which has exited in the form of a bubble and the cycle repeats itself. The theory is that the machinery of bubble formation is sustained by the pumping action of the departing bubbles sucking liquid into the sub-surface channel, spreading of the introduced liquid by capillary forces within the sub-surface channel, and, subsequent evaporation of the liquid to form another generation of bubbles.

It is known in the theory of thin film evaporation heat transfer that if the re-entrant openings are too large the sub-surface volume or channels will flood with liquid refrigerant and no bubbles will form. The relationship recognized by the present invention is that, for a low pressure refrigerant, a small volume of liquid will result in a relatively large bubble, and thus, through resultant momentum forces, serves to intensify the natural pumping mechanism which is responsible for processing liquid through the system of surface pores and sub-surface channels. As a result very small alternating open and closed sections will result in an extremely high performance tube. On the other hand, higher pressure refrigerants yield a much smaller bubble for an equal volume of liquid refrigerant and produce a lower pumping capacity in the system. Therefore a larger re-entrant opening or pore is needed to achieve substantially increased performance in a high performance heat transfer tube of the type described in U.S. Pat. No. 4,765,058 when used with high pressure refrigerants.

This invention may be practiced or embodied in still other ways without departing from the spirit or essential character thereof. The preferred embodiment described herein is therefor illustrative and not restrictive, the scope of the invention being indicated by the appended claims and all variations which come within the meaning of the claims are intended to be embraced therein.

What is claimed is:

1. A heat exchanger comprising;

a heat conductive base member for transferring heat from a heat source on one side thereof to a boiling fluid on the other side thereof;

a plurality of spaced apart fins extending from said other side of said base member, each of said fins having a base portion joined to said base member and a tip portion, said tip portions being bent over toward the next adjacent one of said fins to define a sub-surface channel between adjacent fins, said sub-surface channel having alternating closed sections where a length of said tip portion is bent over an additional amount so that said length of said tip portion contacts an adjacent fin, and, open sections wherein said bent over tip portion is spaced from said adjacent fin, each of said open sections having a cross sectional area of from 0.000220 square inches to 0.000440 square inches, and, the total open area of said open sections is from 14% to 28% of the total surface area of said other side.

2. A heat exchanger as defined in claim 1 wherein said boiling fluid comprises R-22 and said cross sectional area of said open sections are within a range from 0.000267 square inches to 0.000353 square inches, and, the total area of said open sections is from 16.7% to 22.5% of the total surface area of said other side.

3. A heat exchanger as defined in claim 1 wherein said boiling fluid is a higher pressure refrigerant, the slope of the vapor pressure curve of said refrigerant being greater than about 0.60 psi/°F.

4. In a refrigeration system comprising a compressor, a condenser, a pressure reducing means, and an evaporator of the shell-and-tube type interconnected in refrigerant flow relationship, an improved heat transfer surface for said evaporator comprising:

a plurality of tubular members through which a relatively warm fluid to be cooled passes;

a plurality of spaced apart fins extending from the outside surface of said tubular members, the outside surface of said tubular members and said fins being in contact with a refrigerant fluid flowing through said evaporator; and each of said fins having a base portion joined to one of said tubular members and a tip portion, each of said tip portions being bent over toward the next adjacent one of said fins to define a sub-surface channel between adjacent fins, said sub-surface channel having alternating closed sections where a length of said tip portion is bent over an additional amount so that said length of said portion contacts an adjacent fin, and, open sections wherein said bent over tip portion is spaced from said adjacent fin, each of said open sections having a cross sectional area of from 0.000220 square inches to 0.000440 square inches, and, the total open area of said open sections is from 14% to 28% of the total outside surface area of said tubular members.

5. A refrigeration system as defined in claim 4 wherein said refrigerant fluid is R-22 and said cross sectional area of said open sections are within a range from 0.000267 square inches to 0.000353 square inches, and, the total open area of said open sections is from 16.7% to 22.5% of the total outside surface area of said tubular members.

6. A heat exchanger comprising a tube for conducting a relatively warm fluid to be cooled by transferring heat to a boiling fluid surrounding said tube, helical heat transfer fins formed from the outer surface of and substantially coaxially disposed with respect to said tube, said helical fins having base portions integral with the outer surface of said tube, said fins extending outwardly from their base portions to distal portions, the distal portions being bent over towards the next adjacent one of said fins to define a sub-surface channel between adjacent fins, said sub-surface channel having alternating closed sections where a length of said tip portion is bent over an additional amount so that said length of said tip portion contacts an adjacent fin, and, open sections wherein said bent over portion is spaced from said adjacent fin, each of said open section having a cross sectional area of from 0.000220 square inches to 0.000440 square inches, and the total open area of said open sections is from 14% to 28% of the total outside surface area of said tube.

7. The heat exchange tube of claim 6 wherein said boiling fluid is a higher pressure refrigerant, the slope of the vapor pressure curve of said refrigerant being greater than about 0.60 psi/°F.

8. The heat exchange tube of claim 7 wherein said higher pressure refrigerant is selected from the group of refrigerants consisting of R-12, R-13, R-22, R-134a, R-152a, R-500, R-502 and R-503.

9. The heat exchange tube of claim 8 wherein said refrigerant is R-22 and said cross sectional area of said open sections are within a range from 0.000267 square inches to 0.000353 square inches, and, the total area of said open sections is from 16.7% to 22.5% of the total outside surface area of said tube.

* * * * *